US006322719B2

(12) United States Patent
Kaneko et al.

(10) Patent No.: US 6,322,719 B2
(45) Date of Patent: Nov. 27, 2001

(54) REFRIGERATING OIL COMPOSITION

(75) Inventors: Masato Kaneko; Toshinori Tazaki; Shuichi Sakanoue, all of Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 09/749,519

(22) Filed: Dec. 28, 2000

Related U.S. Application Data

(62) Division of application No. 09/030,954, filed on Feb. 26, 1998, now Pat. No. 6,193,906.

(30) Foreign Application Priority Data

Feb. 27, 1997 (JP) ..... 9-044109
Mar. 26, 1997 (JP) ..... 9-072909

(51) Int. Cl.[7] ..... C09K 5/04
(52) U.S. Cl. ..... 252/68; 252/67; 508/579; 508/583; 508/588; 508/590
(58) Field of Search ..... 252/68, 67; 508/579, 508/588, 583, 590

(56) References Cited

U.S. PATENT DOCUMENTS

| | | | | |
|---|---|---|---|---|
| 4,851,144 | | 7/1989 | McGraw et al. . | |
| 4,948,525 | | 8/1990 | Sasaki et al. . | |
| 5,279,752 | | 1/1994 | Hasegawa et al. . | |
| 5,431,835 | | 7/1995 | Katafuchi et al. . | |
| 5,449,472 | * | 9/1995 | Egawa et al. | 252/68 |
| 5,454,963 | | 10/1995 | Kaneko . | |
| 5,494,595 | | 2/1996 | Nieh . | |
| 5,512,198 | | 4/1996 | Sasaki et al. . | |
| 5,543,068 | | 8/1996 | Kaimai et al. . | |
| 5,595,678 | | 1/1997 | Short et al. . | |
| 5,620,950 | | 4/1997 | Kamakura et al. . | |
| 5,639,719 | | 6/1997 | Tanaka et al. . | |
| 5,652,204 | | 7/1997 | Cracknell et al. . | |
| 5,688,433 | | 11/1997 | Kasahara et al. . | |
| 5,704,216 | * | 1/1998 | Hirano et al. | 62/114 |
| 5,801,132 | | 9/1998 | Kaneko et al. . | |
| 5,804,096 | | 9/1998 | Sato et al. . | |
| 6,013,609 | | 1/2000 | Katafuchi . | |

FOREIGN PATENT DOCUMENTS

| | | |
|---|---|---|
| 0 421 765 | 4/1991 | (EP) . |
| 0 557 796 | 9/1993 | (EP) . |
| 0557 796 | 9/1993 | (EP) . |
| 0 696 564 | 2/1996 | (EP) . |
| 0 699 737 | 3/1996 | (EP) . |
| 0 699 742 | 3/1996 | (EP) . |
| 0699737 | 3/1996 | (EP) . |
| 0699742 | 3/1996 | (EP) . |
| 0 736 591 | 10/1996 | (EP) . |
| 97/03153 | 1/1997 | (WO) . |
| 97/49787 | 12/1997 | (WO) . |
| WO 97/49787 | 12/1997 | (WO) . |
| 99/20718 | 4/1999 | (WO) . |
| 99/58628 | 11/1999 | (WO) . |

OTHER PUBLICATIONS

Derwent Abstracts, AN 96–275907, RU 2 047 652 C, Nov. 10, 1995.

* cited by examiner

*Primary Examiner*—Necholus Ogden
(74) *Attorney, Agent, or Firm*—Oblon, Spivak, McClelland, Maier & Neustadt, P.C.

(57) ABSTRACT

A refrigerating oil composition which exhibits excellent lubrication properties when used in combination with certain types of coolant, such as a hydrofluorocarbon coolant, which may serve as substitutes for chlorofluorocarbon coolants which have been implicated as causing environmental problems. The refrigerating oil composition of the present invention is obtained by incorporating, into a component (A); i.e., a base oil containing a synthetic oil, a component (B); i.e, a polyalkylene glycol derivative of formula (I) having a number average molecular weight of 200–3,000:

$$R^1—(OR^2)_m—(OR^3)_n—OR^4 \quad (I)$$

wherein $R^1$ and $R^4$ represent C1–C30 hydrocarbon groups, etc.; $R^2$ represents a C2–C4 alkylene group; $R^3$ represents a C2–C30 alkylene group; m and n are numbers that satisfy the above-described molecular weight conditions, wherein n may be 0; and at least one of $R^1$, $R^3$, and $R^4$ has a hydrocarbon group having six or more carbon atoms.

12 Claims, No Drawings

REFRIGERATING OIL COMPOSITION

This application is a Division of application Ser. No. 09/030,954 Filed on Feb. 26, 1998 U.S. Pat. No. 6,193,906.

BACKGROUND OF THE INVENTION

1. Field of the Invention

The present invention relates to a refrigerating oil composition, and more particularly to a refrigerating oil composition which exhibits excellent lubrication properties when used in combination with certain types of coolant; i.e., a hydrofluorocarbon-type, fluorocarbon-type, hydrocarbon-type, ether-type, carbon dioxide-type, or ammonia-type coolant, preferably in combination with a hydrofluorocarbon-type coolant, which may serve as a substitute for chlorofluorocarbon coolants which have been implicated as causing environmental problems. The refrigerating oil composition of the present invention exhibits notably improved lubrication between aluminum material and steel material to thereby suppresses wear of the materials, and hardly causes clogging of capillary tubes.

2. Background Art

A compression-type refrigerator typically includes a compressor, a condenser, an expansion mechanism (such as an expansion valve), an evaporator, and in some cases a drier. A liquid mixture of a coolant and a refrigerating oil circulates within the closed system of the refrigerator. Conventionally, as coolant in compression-type refrigerators, particularly in air conditioners, there has widely been used chlorodifluoromethane (hereinafter referred to as R22) or a mixture of chlorodifluoromethane and chloropentafluoroethane at a weight ratio of 48.8:51.2 (hereinafter referred to as R502). As lubricating oils in such apparatuses, there have been employed a variety of mineral oils and synthetic oils that satisfy the aforementioned requirements. However, R22 and R502 have recently become more strictly regulated worldwide for fear of causing environmental problems, such as destruction of the ozone layer in the stratosphere. Therefore, as new coolants, hydrofluorocarbons typified by 1,1,1,2-tetrafluoroethane, difluoromethane, pentafluoroethane, and 1,1,1-trifluoroethane (hereinafter referred to as R134a, R32, R125, and R143a, respectively) have become of interest. Hydrofluorocarbons, inter alia, R134a, R32, R125, and R134a, involve no fear of destroying the ozone layer, and thus are preferable coolants for use with compression-type refrigerators. However, when used alone, hydrofluorocarbons have the following disadvantages (1)–(3), as reported in "Energy and Resources" Vol. 16, No. 5, page 474: (1) when R134a is used in an air conditioner in place of R22, operation pressure is low, resulting in an approximate 40% reduction in cooling performance and approximate 5% reduction in efficiency, as compared to the case of R22. (2) R32, though providing better efficiency than R22, requires high operation pressure and is slightly inflammable. (3) R125 is non-inflammable, but has low critical pressure and yields lowered efficiency. R143a, like R32, has the problem of inflammability.

Coolants for compression-type refrigerators are preferably used in existing refrigerators without necessitating any modification to them. In practice, however, due to the aforementioned problems, coolants should be mixtures which contain the above-described hydrofluorocarbons. That is, in creation of a substitute for currently employed R22 or R502, it is desirable to use inflammable R32 or R143a from the point of efficiency, and in order to make the overall coolant non-inflammable, R125 and R134a are preferably added thereto. "The International Symposium on R22 & R502 Alternative refrigerants," 1994, page 166, describes that R32/R134a mixtures are inflammable when the R32 content is 56% or higher. Coolants containing non-inflammable hydrofluorocarbons such as R125 or R134a in amounts of 45% or more are generally preferred, although this range is not necessarily an absolute one and may differ depending on the composition of the coolant.

In a refrigeration system, coolants are used under a variety of different conditions. Therefore, the composition of a hydrofluorocarbon to be incorporated into the coolant preferably does not change greatly from point to point within the refrigeration system. Since a coolant is present in two states—a gas state and a liquid state—in a refrigeration system, when the boiling points of hydrocarbons to be incorporated greatly differ, the composition of the coolant in the form of a mixture may greatly differ from point to point within the refrigeration system, due to the aforementioned reasons.

The boiling points of R32, R143a, R125, and R134a are −51.7° C., −47.4° C., −48.5° C., and −26.3° C., respectively. When R134a is incorporated into a hydrofluorocarbon-containing coolant system, its boiling point must be taken into consideration. When R125 is incorporated into a coolant mixture, its content is preferably from 20–80 wt. %, particularly preferably 40–70 wt. %. When the R125 content is less than 20 wt. %, coolants such as R134a having a boiling point greatly different from that of R125 must be added disadvantageously in great amounts, whereas when the R125 content is in excess of 80 wt. %, the efficiency disadvantageously decreases.

In consideration of the foregoing, preferable substitutes for conventional R22 coolants include mixtures containing R32, R125, and R134a in proportions by weight of 23:25:52 (hereinafter referred to as R407C) or 25:15:60; and mixtures containing R32 and R125 in proportions by weight of 50:50 (hereinafter referred to as R410A) or 45:55 (hereinafter referred to as R410B). Preferable substitute coolants for R502 coolants include mixtures containing R125, R143a, and R134a in proportions by weight of 44:52:4 (hereinafter referred to as R404A); and mixtures containing R125 and R143a in proportions by weight of 50:50 (hereinafter referred to as R507).

These hydrofluorocarbon-type coolants have different properties from conventional coolants. It is known that refrigerating oils which are advantageously used in combination with hydrofluorocarbon-type coolants are those containing as base oils certain types of polyalkylene glycol, polyester, polycarbonate, polyvinyl ether, or similar materials having specific structures, as well as a variety of additives such as antioxidants, extreme pressure agents, defoamers, hydrolysis suppressers, etc.

However, these refrigerating oils have poor lubrication properties in the aforementioned coolant atmosphere, and there arises notable increases in friction between aluminum material and steel material of refrigerators contained in air conditioners for automobiles, electric refrigerators, and household air conditioners, raising great problems in practice. The aluminum-steel frictional portions are important elements in compressors, and are found, for example, between a piston and a piston shoe, and between a swash plate and a shoe section in reciprocation-type compressors (particularly in swash plate-type compressors); between a vane and its housing in rotary compressors; and in the sections of an Oldham's ring and a revolving scroll receiving portion in scroll-type compressors.

A refrigerator is equipped with an expansion valve called a capillary tube. The capillary tube is a thin tube having a diameter of as small as 0.7 mm and thus is apt to become plugged. The plugging phenomenon of a capillary tube is a critical factor that determines the service life of the refrigerator.

Therefore, in the case in which hydrofluorocarbon coolants are used as substitutes for chlorofluorocarbon coolants, there has been need for refrigerating oils which are endowed with excellent lubrication properties, inter alia, improved lubrication between aluminum material and steel material, which suppress friction, and which hardly cause plugging of a capillary tube.

SUMMARY OF THE INVENTION

The present invention was made in view of the foregoing, and a general object of the invention is to provide a refrigerating oil composition which exhibits, among others, the following properties: excellent lubrication properties when used in combination with certain types of coolant; i.e., a hydrofluorocarbon-type, fluorocarbon-type, hydrocarbon-type, ether-type, carbon dioxide-type, or ammonia-type coolant, preferably in combination with a hydrofluorocarbon-type coolant, which may serve as a substitute for chlorofluorocarbon coolants which have been implicated as causing environmental problems; notably improved lubrication between aluminum material and steel material so as to suppress wear of the materials; and ability to inhibit clogging of capillary tubes.

The present inventors have conducted earnest studies, and have found that the above object is effectively attained by the incorporation, into a base oil containing a synthetic oil, of a specific polyalkylene glycol derivative, a specified etherified compound (i.e., an etherified compound of an aliphatic polyhydric alcohol), or an etherified compound of a dimeric or trimeric condensate of the polyhydric alcohol. The present invention was accomplished based on this finding.

Accordingly, in one aspect of the present invention, there is provided a refrigerating oil composition obtained by incorporating, into (A) a base oil containing a synthetic oil, (B) a polyalkylene glycol derivative of formula (I) having a number average molecular weight of 200–3,000:

$$R^1—(OR^2)_m—(OR^3)_n—OR^4 \quad (I)$$

wherein each of $R^1$ and $R^4$ represents a C1–C30 hydrocarbon group or acyl group, or hydrogen; $R^2$ represents a C2–C4 alkylene group; R represents a C2–C30 alkylene group which may or may not be substituted; m and n are numbers that satisfy the above-described molecular weight conditions, wherein n may be 0; and at least one of $R^1$, $R^3$, and $R^4$ has a hydrocarbon group having six or more carbon atoms.

Preferably, the amount of the polyalkylene glycol derivative is 0.1–30 wt. %.

In another aspect of the present invention, there is provided a refrigerating oil composition which comprises a synthetic oil containing a polyalkylene glycol derivative of formula (I) in an amount of 0.1–30 wt. %.

In a further aspect of the present invention, there is provided a refrigerating oil composition which comprises a polyalkylene glycol derivative of formula (I) and a synthetic oil other than the polyalkylene glycol derivative.

Preferably, the amount of the polyalkylene glycol derivative is 0.1–30 wt. %, and that of the synthetic oil other than the polyalkylene glycol derivative is 70–99.9 wt. %.

In a still further aspect of the present invention, there is provided a refrigerating oil composition obtained by incorporating, into (A) a base oil containing a synthetic oil, (C) at least one ethterified compound having a kinematic viscosity of 5–200 $mm^2/s$ at 40° C. and selected from the group consisting of (c-1) etherified compounds of aliphatic polyhydric alcohols having functionality of 3 through 6 and (c-2) etherified compounds of dimeric or trimeric condensates of aliphatic polyhydric alcohols having functionality of 3 through 6.

Preferably, the amount of the etherified compound is 0.1–30 wt. %.

In a yet further aspect of the present invention, there is provided a refrigerating oil composition which comprises a synthetic oil containing the above-described etherified compound in an amount of 0.1–30 wt. %.

In a yet further aspect of the present invention, there is provided a refrigerating oil composition which comprises the above-described etherified compound and a synthetic oil other than the etherified compound.

Preferably, the amount of the etherified compound is 0.1–30 wt. %, and that of the synthetic oil other than the etherified compound is 70–99.9 wt. %.

These and other objects, features, and advantages of the present invention will become apparent from the following description.

MODES FOR CARRYING OUT THE INVENTION

The present invention will next be described in detail.

The refrigerating oil composition of the present invention is obtained by incorporating a specified polyalkylene glycol derivative or a specified ether compound to a base oil containing a synthetic oil. In other words, the refrigerating oil composition of the present invention is formed of a specified polyalkylene glycol derivative or a specified ether compound, and a synthetic oil other than the polyalkylene glycol derivative or the specified ether compound.

Description will be hereafter given of the components of the refrigerating oil composition of the present invention.

Component (B), i.e., polyalkylene glycol derivative, will first be described.

Polyalkylene glycol derivatives which are used in the present invention are represented by formula (I):

$$R^1—(OR^2)_m—(OR^3)_n—OR^4 \quad (I)$$

wherein each of $R^1$ and $R^4$ represents a C1–C30 hydrocarbon group or acyl group, or hydrogen; $R^2$ represents a C2–C4 alkylene group; $R^3$ represents a C2–C30 alkylene group which may or may not be substituted; m and n are numbers that satisfy the above-described molecular weight conditions, wherein n may be 0; and at least one of $R^1$, $R^3$, and $R^4$ has a hydrocarbon group having six or more carbon atoms.

C1–C30 hydrocarbon groups represented by $R^1$ and $R^4$ are (i) saturated or unsaturated, linear or branched aliphatic hydrocarbon groups, in particular alkyl groups derived from aliphatic monohydric alcohols or (ii) substituted or unsubstituted, aromatic hydrocarbon groups, preferably a phenyl group and an alkylphenyl group.

Specific examples of (i) include a methyl group, an ethyl group, an n-propyl group, an isopropyl group, butyl groups, pentyl groups, hexyl groups, heptyl groups, octyl groups, nonyl groups, decyl groups, undecyl groups, dodecyl groups, tridecyl groups, tetradecyl groups, pentadecyl groups, hexadecyl groups, heptadecyl groups, octadecyl groups, and nonadecyl groups.

Examples of (ii) include a methylphenyl group, an ethylphenyl group, a propylphenyl group, a butylphenyl group, a pentylphenyl group, a hexylphenyl group, a heptylphenyl group, an octylphenyl group, a nonylphenyl group, a decylphenyl group, a dodecylphenyl group, a pentadecylphenyl group, a hexadecylphenyl group, and a dinonylphenyl group.

$R^1$ and $R^4$ independently represent acyl groups, which are preferably derived from a carboxylic acid, in particular a saturated or unsaturated monocarboxylic acid. Examples of these acids include acetic acid, propionic acid, butyric acid, lauric acid, myristic acid, palmitic acid, stearic acid, and oleic acid.

$R^2$ represents a C2–C4 alkylene group, and examples of the oxyalkylene group (—$OR^2$) which serves as a recurring unit include an oxyethylene group, an oxypropylene group, and an oxybutylene group.

$R^3$ in the above-described formula (I) represents a C2–C30 alkylene group which may or may not be substituted. Examples of substituents of the substituted alkylene groups include an alkyl group, a phenyl group, and an alkylphenyl group.

Copolymerization of $OR^2$ and $OR^3$ may result a random or block copolymer, with the block copolymer being preferred from the viewpoint of molecular weight.

At least one of $R^1$, $R^3$, and $R^4$ must have a hydrocarbon group having six or more carbon atoms, examples of which include a phenyl group or an alkylphenyl group.

Specific examples of the polyalkylene glycol derivatives represented by the above-described formula (I) include polyethylene glycol di-sec-butylphenyl methyl ether; polypropylene glycol di-sec-butylphenyl methyl ether; polyethylene glycol polypropylene glycol di-sec-butylphenyl methyl ether; polyethylene glycol nonyl methyl ether; polypropylene glycol nonyl methyl ether; polyethylene glycol polypropylene glycol nonyl methyl ether; polyethylene glycol nonylphenyl methyl ether; polypropylene glycol nonylphenyl methyl ether; polyethylene glycol polypropylene glycol nonylphenyl methyl ether; polyethylene glycol polynonylene glycol dimethyl ether; and polypropylene glycol polynonylene glycol dimethyl ether.

In the present invention, the number average molecular weight of the alkylene glycol derivatives represented by the above-described formula (I) is 200–3,000. When the number average molecular weight is 200 or less, improvement in lubricity and preventive effect against plugging of capillary tube are not satisfactory, whereas when it is in excess of 3,000, compatibility between the oil composition and a coolant (phase-separation temperature) disadvantageously decreases.

The above-described alkylene glycol derivatives have a kinematic viscosity of preferably 5–200 $mm^2/s$, more preferably 10–100 $mm^2/s$, as measured at 40° C.

In the present invention, the above-described alkylene glycol derivative may be used singly or in combination of two or more species. The derivative is added to the composition preferably in an amount of 0.1–30 wt. % with respect to the total amount of the composition. When the amount is 0.1 wt. % or less, the effect of the present invention may not fully be attained, whereas when it is in excess of 30 wt. %, there may not be obtained effect commensurate with the amount employed, and in addition, the solubility in a base oil may be decreased. The amount of the alkylene glycol derivative is more preferably 0.1–15 wt. %, particularly preferably 0.5–10 wt. %.

In the present invention, the specified ether compound serving as component (C), is at least one species selected from the group consisting of (c-1) aliphatic polyhydric alcohols having functionality of 3 through 6 and (c-2) etherified compounds of dimeric or trimeric condensates of the polyhydric alcohol. Hereafter, description will be given of these compounds.

The etherified compounds of the aliphatic polyhydric alcohols having functionality of 3 through 6 may be represented by the below-described formulas (I-a) through (I-f).

(I-a)

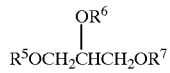

(I-b)

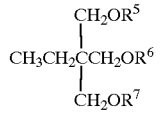

(I-c)

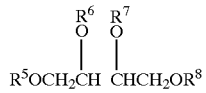

(I-d)

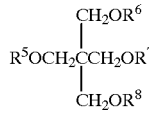

(I-e)

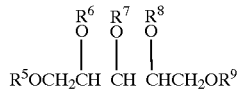

(I-f)

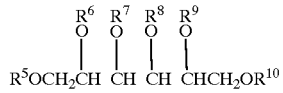

wherein each of $R^5$ through $R^{10}$, which may be identical to or different from one another, represents hydrogen, a C1–C18 linear or branched alkyl group, aryl group, or aralkyl group; or a glycol ether residue represented by —$(R^aO)_n$—$R^b$ (wherein $R^a$ represents a C2–C6 alkylene group, $R^b$ represents a C1–C20 alkyl group, aryl group, or aralkyl group, n is a number between 1 and 10 inclusive); and at least one of $R^5$ through $R^{10}$ is not hydrogen.

Examples of $R^5$ through $R^{10}$ in the above-described formulas (I-a) through (I-f) include a methyl group, an ethyl group, an n-propyl group, an isopropyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a phenyl group, and a benzyl group. Each of the groups $R^5$ through $R^{10}$ also encompasses corresponding partial ether compounds wherein part of $R^5$ through $R^{10}$ is hydrogen.

Examples of aliphatic polyhydric alcohols having functionality of 3 through 6 which are advantageously used in the present invention include glycerol, trimethylolpropane, erythritol, pentaerythritol, arabitol, sorbitol, and mannitol.

In the present invention, examples of components (c-2); i.e, etherified compounds of dimeric or trimeric condensates of aliphatic polyhydric alcohols having functionality of 3 through 6, include those represented by formula (I-g) and (I-h)—which are etherified compounds of an alcohol corresponding to formula (I-a)—and those represented by formula (I-i) and (I-j)—which are etherified compounds of an alcohol corresponding to formula (I-d).

(I-g)

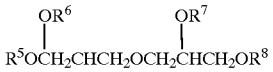

(I-h)

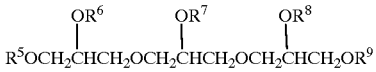

(I-I)

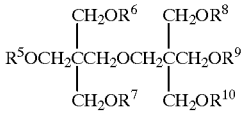

(I-j)

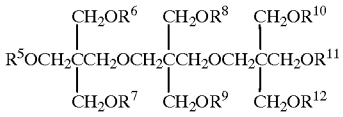

wherein each of $R^5$ through $R^{12}$, which may be identical to or different from one another, represents hydrogen, a C1–C18 linear or branched alkyl group, aryl group, or aralkyl group; or a glycol ether residue represented by $—(R^aO)_n—R^b$ (wherein $R^a$ represents a C2–C6 alkylene group, $R^b$ represents a C1–C20 alkyl group, aryl group, or aralkyl group, n is a number between 1 and 10 inclusive); and at least one of $R^5$ through $R^{12}$ is not hydrogen.

Examples of dimeric or trimeric condensates of aliphatic polyhydric alcohols having functionality of 3 through 6 include diglycerol, ditrimethylolpropane, dipentaerythritol, disorbitol, triglycerol, tritrimethylolpropane, tripentaerythritol, and trisorbitol.

Specific examples of components (c-1) and (c-2) represented by the above-described formulas (I-a) through (I-j) include trihexyl ether, dimethyl octyl triether, di(methyloxyisopropylene) dodecyl triether, diphenyl octyl triether, or di(phenyloxyisopropylene) decyl triether of glycerol; trihexyl ether, dimethyl octyl triether, or di(methyloxyisopropylene) dodecyl triether of trimethylollpropane; tetrahexyl ether, trimethyl octyl tetraether, or tri (methyloxyisopropylene) dodecyl tetraether of pentaerythritol; hexapropyl ether, tetramethyl octyl pentaether, or hexa(methyloxyisopropylene) ether of sorbitol; tetrabutyl ether, dimethyl dioctyl tetraether, or tri (methyloxyisopropylene) decyl tetraether of diglycerol; pentaethyl ether, trimethyl dioctyl pentaether, or tetra (methyloxyisopropylene) decyl pentaether of triglycerol; tetrabutyl ether, dimethyl dioctyl tetraether, or tri (methyloxyisopropylene) dodecyl tetraether of ditrimethylolpropane; pentaethyl ether, trimethyl dioctyl pentaether, or tetra(methyloxyisopropylene) decyl pentaether, of tritrimethylolpropane; hexapropyl ether, pentamethyl octyl hexaether, or hexa(methyloxyisopropylene) ether of dipentaerythritol; octapropyl ether, pentamethyl octyl hexaether, or hexa(methyloxyisopropylene) ether of tripentaerythritol; and octamethyl dioctyl decaether or deca (methyloxyisopropylene) ether of disorbitol. Of these, preferred ones are diphenyl octyl triether of glycerol, di(methyloxyisopropylene) dodecyl triether of trimethylolpropane, tetrahexyl ether of pentaerythritol, hexapropyl ether of sorbitol, dimethyl dioctyl tetraether of diglycerol, tetra(methyloxyisopropylene) decyl pentaether of triglycerol, hexapropyl ether of dipentaerythritol, and pentamethyl octyl hexaether of tripentaerythritol.

The kinematic viscosity (at 40°) of the ether compounds serving as components (c-1) and (c-2) is 5–200 $mm^2/s$, preferably 10–100 $mm^2/s$. When the kinematic viscosity is less than 5 $mm^2/s$, improvement of lubrication characteristics and preventive effect against plugging of capillary tube are not satisfactory, whereas when the kinematic viscosity is in excess of 200 $mm^2/s$, compatibility between the oil composition and a coolant (phase-separation temperature) disadvantageously decreases.

In the refrigerating oil composition of the present invention, the above-described etherified compounds (C) may be used singly or in combination of two or more species. The amount of the etherified compounds (C) is preferably 0.1–30 wt. % with respect to the total weight of the composition. When the amount is less than 0.1 wt. %, the effects of the present invention are not fully exerted, whereas when the amount is in excess of 30 wt. %, improved effects will no longer obtained, and in addition, the solubility in the base oil may decrease. The amount of compounds (C) is more preferably 0.1–15 wt. %, particularly preferably 0.5–10 wt. %.

Next, description will be given of the synthetic oil which may be used as or incorporated in the base oil—component (A)—of the refrigerating oil composition of the present invention.

No particular limitation is imposed on the synthetic oil, so long as it is ordinarily employed as a base oil or a component of a base oil for refrigerating oil compositions. The synthetic oil used in the present invention has a kinematic viscosity (at 40° C.) of 2–500 $mm^2/s$, preferably 5–200 $mm^2/s$ particularly preferably 10–100 $mm^2/s$. Although no particular limitation is imposed on the pour point (which is an index of low temperature fluidity), it is preferably not higher than −10° C.

The synthetic oil may be selected from among a variety of synthetic oils that meet the above requirements in accordance with, for example, use. Examples of the synthetic oil include oxygen-containing organic compounds and hydrocarbon-type synthetic oils.

Among a variety of synthetic oils, oxygen-containing compounds include a synthetic oil having an ether moiety, ketone moiety, ester moiety, carbonate moiety, and hydroxyl moiety in the molecule. The synthetic oil may further contain a hetero atom such as S, P, F, Cl, Si, and N. Specific examples of such oxygen-containing compounds include (a) polyvinyl ether, (b) polyester, (c) polyhydric alcohol ester, (d) a carbonate derivative, (e) polyether-ketone, (f) a fluorinated oil, and (g) polyalkylene glycol.

Examples of the polyvinyl ether (a) include polyvinyl ether compounds (1) having a structural unit represented by formula (II):

(II)

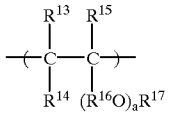

wherein each of $R^{13}$ through $R^{15}$, which may be identical to or different from one another, represents hydrogen or a C1–C8 hydrocarbon group; $R^{16}$ represents a C1–C10 divalent hydrocarbon group or a C2–C20 divalent hydrocarbon group having ether linkage oxygen; $R^{17}$ represents a C1–C20 hydrocarbon group; "a" is a mean value falling in the range of 0–10 inclusive; $R^{13}$ through $R^{17}$ may be identical to or different from one another in every structural unit; and in the case in which there are a plurality of $R^{16}O$ groups, they may be identical to or different from one another. There may also be used, as polyvinyl ether (a), polyvinyl ether compounds (2) which comprise a block or random copolymer having a structural unit represented by the above-described formula (II) and a structural unit represented by formula (III):

(III)

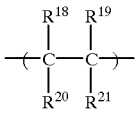

wherein each of $R^{18}$ through $R^{21}$, which may be identical to or different from one another, represents a hydrogen atom or a C1–C20 hydrocarbon group; and $R^{18}$ through $R^{21}$ may be identical to or different from one another in every structural unit. Moreover, polyvinyl ether compounds (3) composed of a mixture of polyvinyl ether compound (1) and polyvinyl compound (2) may also be used.

Each of $R^{13}$ through $R^{15}$ represents a hydrogen group or a C1–C8 hydrocarbon group, preferably a C1–C4 hydrocarbon group. Examples of the hydrocarbon groups include an alkyl group such as a methyl group, an ethyl group, an n-propyl group, an isopropyl group, a butyl group, a pentyl group, a hexyl group, a heptyl group, and an octyl group; a cycloalkyl group such as a cyclopentyl group, a cyclohexyl group, a methylcyclohexyl group, an ethylcyclohexyl group, and a dimethylcyclohexyl group; an aryl group such as a phenyl group, a methylphenyl group, an ethylphenyl group, and a dimethylphenyl group; and an arylalkyl group such as a benzyl group, a phenylethyl group, and a methylbenzyl group. Of these, hydrogen is particularly preferred.

$R^{16}$ in formula (II) represents a divalent hydrocarbon group having 1–10 carbon atoms, preferably 2–10 carbon atoms or a C2–C20 divalent hydrocarbon group having ether linkage oxygen. Examples of the C1–C10 divalent hydrocarbon groups include a divalent aliphatic group such as a methylene group, an ethylene group, a phenylethylene group, a 1,2-propylene group, a 2-phenyl-1,2-propylene group, a 1,3-propylene group, a butylene group, a pentylene group, a hexylene group, a heptylene group, an octylene group, a nonylene group, and a decylene group; an alicyclic group having two linkage positions in the alicyclic hydrocarbon such as cyclohexane, methylcyclohexane, ethylcyclohexane, dimethylcyclohexane, and propylcyclohexane; a divalent aromatic hydrocarbon group such as a phenylene group, a methylphenylene group, an ethylphenylene group, a dimethylphenylene group, and a naphthylene group; an alkyl aromatic group having a monvalent lingage position both in the alkyl moiety and the aromatic moiety of the alkyl aromatic hydrocarbon such as toluene, xylene, and ethylbenzene; and an alkyl aromatic group having a linkage position in the alkyl moiety of the polyalkyl aromatic hydrocarbon such as diethylbenzene. Of these, a C2–C4 aliphatic group is particularly preferred.

Preferable examples of the C2–C20 divalent hydrocarbon groups having ether linkage oxygen include a methoxymethylene group, a methoxyethylene group, a methoxymethylethylene group, a 1,1-bismethoxymethylethylene group, a 1,2-bismethoxymethylethylene group, an ethoxymethylethylene group, a (2-methoxyethoxy)methylethylene group, and a (1-methyl-2-methoxy)methylethylene group. The suffix "a" in the formula (II) represents the recurrence number of $R^{16}O$, which average value is 0–10, preferably 0–5. Each of a plurality of $R^{16}O$ groups may be identical to or different from one another.

$R^{17}$ in the formula (II) represents a hydrocarbon group having 1–20 carbon atoms, preferably 1–10 carbon atoms. Examples of the hydrocarbon groups include alkyl groups such as a methyl group, an ethyl group, an n-propyl group, an isopropyl group, butyl groups, pentyl groups, hexyl groups, heptyl groups, octyl groups, nonyl groups, and decyl groups; cycloalkyl groups such as a cyclopentyl group, a cyclohexyl group, methylcyclohexyl groups, ethylcyclohexyl groups, propylcyclohexyl groups, and dimethylcyclohexyl groups; aryl groups such as a phenyl group, methylphenyl groups, ethylphenyl groups, dimethylphenyl groups, propylphenyl groups, trimethylphenyl groups, butylphenyl groups, and naphthyl groups; and arylalkyl groups such as a benzyl group, phenylethyl groups, methylbenzyl groups, phenylpropyl groups, and phenylbutyl groups.

The polyvinyl ether compound (1) has a structural unit represented by the above-described formula (II). The recurrence number (polymerization degree) may be determined in accordance with the kinematic viscosity of interest, typically 2–500 $mm^2/s$ at 40° C. Also, the polyvinyl ether compound preferably has a carbon/oxygen molar ratio of 4.2– 7.0. When the molar ratio is less than 4.2, hygroscopicity may be increased, whereas when the ratio is in excess of 7.0, compatibility to coolants may decrease.

The polyvinyl ether compound (2) comprises a block or random copolymer having a structural unit represented by the above-described formula (II) and a structural unit represented by the above-described formula (III). Each of $R^{18}$ through $R^{21}$ in formula (III), which may be identical to or different from one another, represents a hydrogen atom or a C1–C20 hydrocarbon group. Examples thereof are common to those described for $R^{17}$. $R^{18}$ through $R^{21}$ may be identical to or different from one another in every structural unit.

The polymerization degree of the polyvinyl ether compound (2) comprising a block or random copolymer having a structural unit represented by the above-described formula (II) and a structural unit represented by the above-described formula (III) may be selected in accordance with the kinematic viscosity of interest, typically 2–200 $mm^2/s$ at 40° C. Also, the polyvinyl ether compound preferably has a carbon/oxygen molar ratio of 4.2–7.0. When the molar ratio is less than 4.2, the hygroscopicity may increase, whereas when the ratio is in excess of 7.0, compatibility to coolants may decrease.

Moreover, the polyvinyl ether compound (3) is made up of a mixture of the above-described polyvinyl ether compound (1) and the above-described polyvinyl ether compound (2), wherein the blending ratio of the two compounds are not particularly limited.

The polyvinyl ether compounds (1) and (2) used in the present invention may be manufactured through polymerization of the corresponding vinyl ether monomers and copolymerization of the corresponding hydrocarbon monomer having an olefinic double bond and the corresponding vinyl ether monomer. The vinyl ether monomers which may be used herein are represented by the following formula (IV):

(IV)

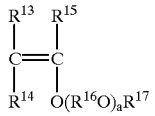

wherein $R^{13}$ through $R^{17}$ and "a" are identical to those as described above. There are a variety of vinyl ether monomers corresponding to the polyvinyl ether compounds (1) and (2). Examples of such vinyl ether monomers include vinyl methyl ether, vinyl ethyl ether, vinyl n-propyl ether, vinyl isopropyl ether, vinyl n-butyl ether, vinyl isobutyl ether, vinyl sec-butyl ether, vinyl tert-butyl ether, vinyl n-pentyl ether, vinyl n-hexyl ether, vinyl 2-methoxyethyl ether, vinyl 2-ethoxyethyl ether, vinyl 2-methoxy-1-methylethyl ether, vinyl 2-methoxy-2-methyl ether, vinyl 3,6-dioxaheptyl ether, vinyl 3,6,9-trioxadecyl ether, vinyl 1,4-dimethyl-3,6-dioxaheptyl ether, vinyl 1,4,7-trimethyl-3,6,9-trioxadecyl ether, vinyl 2,6-dioxa-4-heptyl ether, vinyl 2,6,9-trioxa-4-decyl ether, 1-methoxypropene, 1-ethoxypropene, 1-n-propoxypropene, 1-isopropoxypropene, 1-n-butoxypropene, 1-isobutoxypropene, 1-sec-butoxypropene, 1-tert-butoxypropene, 2-methoxypropene, 2-ethoxypropene, 2-n-propoxypropene, 2-isopropoxypropene, 2-n-butoxypropene, 2-isobutoxypropene, 2-sec-butoxypropene, 2-tert-butoxypropene, 1-methoxy-1-butene, 1-ethoxy-1-butene, 1-n-propoxy-1-butene, 1-isopropoxy-1-butene, 1-n-butoxy-1-butene, 1-isobutoxy-1-butene, 1-sec-butoxy-1-butene, 1-tert-butoxy-1-butene, 2-methoxy-1-butene, 2-ethoxy-1-butene, 2-n-propoxy-1-butene, 2-isopropoxy-1-butene, 2-n-butoxy-1-butene, 2-isobutoxy-1-butene, 2-sec-butoxy-1-butene, 2-tert-butoxy-1-butene, 2-methoxy-2-butene, 2-ethoxy-2-butene, 2-n-propoxy-2-butene, 2-isopropoxy-2-butene, 2-n-butoxy-2-butene, 2-isobutoxy-2-butene, 2-sec-butoxy-2-butene, and 2-tert-butoxy-2-butene.

The hydrocarbon monomer having an olefinic double bond is represented by the below-described formula (V):

(V)

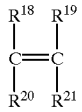

wherein $R^{18}$ through $R^{21}$ are identical to those as described above. Examples of the above monomer include ethylene, propylene, butenes, pentenes, hexenes, heptenes, octenes, diisobutylene, triisobutylene, styrene, and alkyl-substituted styrenes.

The polyvinyl ether compound used in the present invention is preferably terminated with the following groups. Namely, one terminal group is represented by formula (VI) or formula (VII):

(VI)

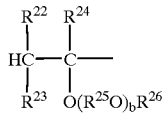

-continued (VII)

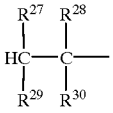

wherein each of $R^{22}$ through $R^{24}$, which may be identical to or different from one another, represents a hydrogen atom or a C1–C8 hydrocarbon group; each of $R^{27}$ through $R^{30}$, which may be identical to or different from one another, represents a hydrogen atom or a C1–C20 hydrocarbon group; $R^{25}$ represents a C1–C10 divalent hydrocarbon group or a C2–C20 divalent hydrocarbon group having ether linkage oxygen; $R^{26}$ represents a C1–C20 hydrocarbon group; b represents an average number which falls within the range from 0 to 10 inclusive; and in the case in which there are a plurality of $R^{25}O$ groups, they may be identical to or different from one another. The other terminal group is represented by formula (VIII) or formula (IX):

(VIII)

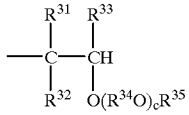

(IX)

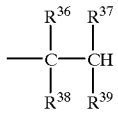

wherein each of $R^{31}$ through $R^{33}$, which may be identical to or different from one another, represents a hydrogen atom or a C1–C8 hydrocarbon group; each of $R^{36}$ through $R^{39}$, which may be identical to or different from one another, represents a hydrogen atom or a C1–C20 hydrocarbon group; $R^{34}$ represents a C1–C10 divalent hydrocarbon group or a C2–C20 divalent hydrocarbon group having ether linkage oxygen; $R^{35}$ represents a C1–C20 hydrocarbon group; c is an average number which falls within the range from 0 to 10 inclusive; a plurality of $R^{34}O$ groups may be identical to or different from one another. Alternatively, one terminal group may be represented by formula (VI) or formula (VII) and the other terminal group may be represented by formula (X):

(X)

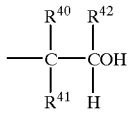

wherein each of $R^{40}$ through $R^{42}$, which may be identical to or different from one another, represents a hydrogen atom or a C1–C8 hydrocarbon group.

Of these polyvinyl ether compounds, the following compounds are particularly preferred as the base oil of the refrigerating composition of the present invention:

(1) a polyvinyl ether compound having one terminal group represented by formula (VI) or formula (VII) and another terminal group represented by formula (VIII) or formula (IX) and having a structural unit represented by formula (II), wherein each of $R^{13}$ through $R^{15}$ represents a hydrogen atom; "a" is a number between 0 and 4 inclusive; $R^{16}$ represents a C2–C4 divalent hydrocarbon group; and $R^{17}$ represents a C1–C20 hydrocarbon group;

(2) a polyvinyl ether compound composed exclusively of structural units of formula (II), each structural unit having one terminal group represented by formula (VI) and another terminal group represented by formula (VIII), wherein each of $R^{13}$ through $R^{15}$ in formula (II) represents a hydrogen atom; "a" is a number between 0 and 4 inclusive; R16 represents a C2–C4 divalent hydrocarbon group; and $R^{17}$ represents a C1–C20 hydrocarbon group;

(3) a polyvinyl ether compound having one terminal group represented by formula (VI) or formula (VII) and another terminal group represented by formula (X) and having a structural unit represented by formula (II), wherein each of $R^{13}$ through $R^{15}$ represents a hydrogen atom; "a" is a number between 0 and 4 inclusive; $R^{16}$ represents a C2–C4 divalent hydrocarbon group; and $R^{17}$ represents a C1–C20 hydrocarbon group; and (4) a polyvinyl ether compound composed exclusively of structural units of formula (II), each structural unit having one terminal group represented by formula (VI) and another terminal group represented by formula (IX), wherein each of $R^{13}$ through $R^{15}$ in formula (II) represents a hydrogen atom; "a" is a number between 0 and 4 inclusive; $R^{16}$ represents a C2–C4 divalent hydrocarbon group; and $R^{17}$ represents a C1–C20 hydrocarbon group.

Alternatively, there may be used a polyvinyl ether compound having a structural unit of formula (II) having one terminal group represented by formula (VI) and another terminal group represented by formula (XI):

(XI)

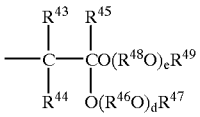

wherein each of $R^{43}$ through $R^{45}$, which may be identical to or different from one another, represents a hydrogen atom or a C1–C8 hydrocarbon group; each of $R^{46}$ and $R^{48}$, which may be identical to or different from each other, represents a C2–C10 divalent hydrocarbon group; each of $R^{47}$ and $R^{49}$, which may be identical to or different from each other, represents a C1–C10 hydrocarbon group; each of d and e, which may be identical to or different from each other, is an average number which falls within the range from 0 to 10 inclusive; a plurality of $R^{46}O$ groups and a plurality of $R^{48}O$ groups may be identical to or different from one another. Furthermore, polyvinyl ether compounds described in detail in Japanese Patent Application No. 8-18837 may also be used. Among the compounds described in this publication, useful ones are polyvinyl ether compounds comprising a homopolymer or a copolymer of an alkylvinyl ether having a weight average molecular weight of 300–3000, preferably 300–2000, and having a structural unit represented by formula (XII) or formula (XIII):

(XII)

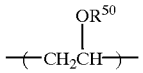

(XIII)

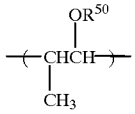

wherein $R^{50}$ represents a C1–C8 hydrocarbon groups, the structural unit having one terminal group represented by formula (XIV) or formula (XV):

(XIV)

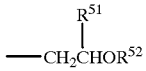

(XV)

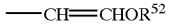

wherein $R^{51}$ represents a C1–C3 alkyl group and $R^{52}$ represents a C1–C8 hydrocarbon group.

Also, there may preferably be used a polyvinyl ether compound having structural unit (A) represented by formula (XVI):

(XVI)

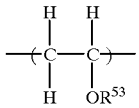

wherein $R^{53}$ represents a C1–C3 hydrocarbon group which may or may not have an intramolecular ether linkage, and structural unit (B) represented by formula (XVII):

(XVII)

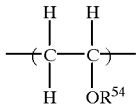

wherein $R^{54}$ represents a C3–C20 hydrocarbon group which may or may not have an intramolecular ether linkage (provided that $R^{53}$ in structural unit (A) is different from $R^{54}$ in structural unit (B)). Preferably, $R^{53}$ is a methyl group or an ethyl group and $R^{54}$ is a C3–C6 alkyl group, more preferably $R^{53}$ is an ethyl group and $R^{54}$ is an isobutyl group. In this case, a molar ratio of structural unit (A) to structural unit (B) is preferably 95:5 to 50:50.

Any one of the ether compounds described in Japanese Patent Application Laid-Open (kokai) Nos. 6-128578, 6-234814, 6-234815, and 8-193196 may be used as the above-described polyvinyl ether compound.

The polyvinyl ether compound may be manufactured through radical polymerization, cationic polymerization, or radiation-induced polymerization of the above-described monomers. For example, vinyl ether monomers are polymerized through the below-described method to yield a polymer having a desired viscosity.

For initializing polymerization, Broensted acids, Lewis acids, or organometallic compounds may be used in combination with water, alcohols, phenols, acetals, or adducts of vinyl ethers and carboxylic acids.

Examples of Broensted acids include hydrofluoric acid, hydrochloric acid, hydrobromic acid, hydroiodic acid, nitric acid, sulfuric acid, trichloroacetic acid, and trifluoroacetic acid. Examples of Lewis acids include boron trifluoride, aluminum trichloride, aluminum tribromide, tin tetrachloride, zinc dichloride, and ferric chloride, with boron trifluoride being particularly preferred. Examples of organometallic compounds include diethylaluminum chloride, ethylaluminum chloride, and diethylzinc.

For combination therewith, any of water, alcohols, phenols, acetals, or adducts of vinyl ethers and carboxylic acids may be arbitrarily used.

Examples of alcohols include C1–C20 saturated aliphatic alcohols such as methanol, ethanol, propanol, isopropanol, butanol, isobutanol, sec-butanol, tert-butanol, pentanols, hexanols, heptanols, and octanols and a C3–C10 unsaturated aliphatic alcohol such as allyl alcohol.

Examples of carboxylic acids in the adducts of carboxylic acid and vinyl ether include acetic acid, propionic acid, n-butyric acid, isobutyric acid, n-valeric acid, isovaleric acid, 2-methylbutyric acid, pivalic acid, n-caproic acid, 2,2-dimethylbutyric acid, 2-methylvaleric acid, 3-methylvaleric acid, 4-methylvaleric acid, enanthic acid, 2-methylcapronic acid, caprylic acid, 2-ethylcaproic acid, 2-n-propylvaleric acid, n-nonanoic acid, 3,5,5-trimethylcaproic acid, and undecanoic acid. The vinyl ethers in the adducts may be identical to or different from those subjected to polymerization. These adducts of vinyl ether and carboxylic acid are obtained by mixing the two components and causing reaction at about 0–100° C. The resultant material may be used in further reactions with or without separation by, for example, distillation.

When water, alcohols, or phenols are used, the polymerization initiation end of the polymer is hydrogen. When acetals are used, the polymerization initiation end of the polymer is hydrogen or a moiety formed through elimination of one alkoxy group from the used acetal. When adducts of vinyl ether and carboxylic acid are used, the polymerization initiation end of the polymer has a moiety formed through elimination of an alkylcarbonyloxy group belonging to the carboxylic acid from the used adduct.

Concerning the terminal end, when water, alcohols, or phenols are used, the termination end is an acetal, an olefin, or an aldehyde; and when adducts of vinyl ethers with carboxylic acids are used, the termination end is a hemiacetal carboxylate ester.

The thus-obtained ends of the polymer may be converted to desired moieties through known methods. Examples of the groups include a saturated hydrocarbon residue, an ether residue, an alcohol residue, a ketone residue, a nitrile residue, and an amide residue, with a saturated hydrocarbon residue, an ether residue, and an alcohol residue being preferred.

Polymerization of the vinyl ether monomers represented by formula (IV) may be initiated at a temperature from −80° C. to 150° C., is typically conducted at a temperature from −80° C. to 50° C., and is completed approximately after 10 seconds to 10 hours from initiation, which time may vary depending on the type of monomer and initiator.

The molecular weight of the target polymer may be regulated in such a manner that, when polymers having a low molecular weight are desired, the amount of water, alcohols, phenols, acetals, and adducts of vinyl ethers and carboxylic acids represented by the above-described formula (IV) is decreased; and conversely, when polymers having a high molecular weight are desired, the amount of the above-described Broensted acids and Lewis acids is decreased.

Polymerization is typically conducted in the presence of a solvent. No particular limitation is imposed on the solvent, so long as it dissolves sufficient amounts of starting materials and is inert to reactions. Examples of the solvent include hydrocarbons such as hexane, benzene, or toluene and an ether such as ethyl ether, 1,2-dimethoxyethane, or tetrahydrofuran. The polymerization can be terminated through addition of an alkali. The target polyvinyl ether compound having a structural unit represented by formula (II) is obtained through typical separation-purification methods after termination of the polymerization.

The polyvinyl ether compounds which are used in the present invention preferably have a carbon/oxygen molar ratio which falls within the range from 4.2 to 7.0. When the carbon/oxygen molar ratio of the starting monomer is regulated, polymers having a carbon/oxygen molar ratio falling within the above range can be created. That is, when a monomer having a high carbon/oxygen molar ratio is used in a predominant amount, the resultant polymer will have a high carbon/oxygen ratio, and when a monomer having a low carbon/oxygen molar ratio is used in a predominant amount, the resultant polymer will have a low carbon/oxygen ratio.

Alternatively, the molar ratio may be controlled by suitably selecting the combination of an initiator (water, alcohols, phenols, acetals, and adducts of vinyl ether and carboxylic acid) and a monomer, as already described for the polymerization method of vinyl ether monomers. When the initiator employed is an alcohol, phenol, etc. having a carbon/oxygen molar ratio higher than that of the monomer to be polymerized, the resultant polymer will have a carbon/oxygen ratio higher than that of the starting monomer, whereas when an alcohol having a low carbon/oxygen molar ratio (such as methanol or methoxyethanol) is used, the resultant polymer will have a carbon/oxygen ratio lower than that of the starting monomer.

Moreover, when a vinyl ether monomer and a hydrocarbon monomer having an olefinic double bond are copolymerized, there may be obtained a polymer having a carbon/oxygen molar ratio higher than that of the vinyl ether monomer. The ratio in this case may be regulated by modifying the proportion of the hydrocarbon monomer having an olefinic double bond and the number of carbon atoms of the monomer.

Examples of polyesters (b) include aliphatic polyester derivatives having a molecular weight of 300–2,000 and having a structural unit represented by the following formula (XVIII):

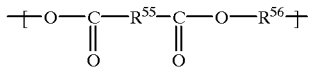

(XVIII)

wherein $R^{55}$ represents C1–C10 alkylene group and $R^{56}$ represents a C2–C10 alkylene group or C4–C20 oxalkylene group.

$R^{5}5$ in the formula (XVIII) represents a C1–C10 alkylene, examples of which include a methylene group, an ethylene group, a propylene group, anethylmethylene group, a 1,1-dimethylethylene group, a 1,2-dimethylethylene group, an n-butylethylene group, an isobutylethylene group, a 1-ethyl-2-methylethylene group, a 1-ethyl-1-methylethylene group, a trimethylene group, a tetramethylene group, and a pentamethylene group, with an alkylene group having 6 or less carbon atoms being preferred. Also, $R^{56}$ represents a C2–C10 alkylene group or a C4–C20 oxalkylene group. Examples of the alkylene groups are identical to those of $R^{55}$ (except a methylene group), with a C2–C6 alkylene group being preferred. Examples of the oxalkylene groups include a 3-oxa-1,5-pentylene group, a 3,6-dioxa-1,8-octylene group, a 3,6,9-trioxa-1,11-undecylene group, a 3-oxa-1,4-dimethyl-1,5-pentylene group, a 3,6-dioxa-1,4,7-trimethyl-1,8-octylene group, a 3,6,9-trioxa-1,4,7,10-tetramethyl-1,11-undecylene group, a 3-oxa-1,4-diethyl-1,5-pentylene group, a 3,6-dioxa-1,4,7-triethyl-1,8-octylene group, a 3,6,9-trioxa-1,4,7,10-tetraethyl-1,11-undecylene group, a 3-oxa-1,1,4,4-tetramethyl-1,5-pentylene group, a 3,6-dioxa-1,1,4,4,7,7-hexamethyl-1,8-octylene group, a 3,6,9-trioxa-1,1,4,4,7,7,10,10-octamethyl-1,11-undecylene group, a 3-oxa-1,2,4,5-tetramethyl-1,5-pentylene group, a 3,6-dioxa-1,2,4,5,7,8-hexamethyl-1,8-octylene group, a 3,6,9-trioxa-1,2,4,5,7,8,10,11-octamethyl-1,11-undecylene group, a 3-oxa-1-methyl-1,5-pentylene group, a 3-oxa-1-ethyl-1,5-pentylene group, a 3-oxa-1,2,dimethyl-1,5-pentylene group, a 3-oxa-1-methyl-4-ethyl-1,5-pentylene group, a 4-oxa-2,2,6,6-tetramethyl-1,7-heptylene group, and a 4,8-dioxa-2,2,6,6,10,10-hexamethyl-1,11-undecylene group. $R^{55}$ and $R^{56}$ may be identical to or different from each other in every structural unit.

Moreover, the aliphatic polyester derivatives represented by the above-described formula (XVIII) preferably have a molecular weight (measured by GPC) of 300–2,000. When the molecular weight is 300 or less, the kinematic viscosity is too low, whereas when it is in excess of 2,000, the derivatives become wax-like, both of which are not preferred for refrigerating oils.

Any one of the polyesters described in detail in International Patent Publication WO91/07479 may be used as the above-described polyesters.

Polyhydric alcohols esters (c) which may be used are esterified products of a polyhydric alcohol having at least two hydroxyl groups (preferably a polyhydric alcohol having 2–6 hydroxyl groups) and a carboxylic acid (preferably one or more species of C2–C18 monocarboxylic acids). Such polyhydric alcohols esters are represented by formula (XIX):

$$R^{57}\,(OCOR^{58})_f \qquad \text{(XIX)}$$

wherein $R^{57}$ represents a hydrocarbon group; $R^{58}$ represents a hydrogen atom or a C1–C22 hydrocarbon group; f is an integer between 2 and 6 inclusive; and a plurality of —$OCOR^{58}$ groups may be identical to or different from one another.

In the above-described formula (XIX), $R^{57}$ represents a linear or branched hydrocarbon group, preferably a C2–C10 alkyl group, and $R^{58}$ represents a hydrogen atom or a C1–C22 hydrocarbon group, preferably a C2–C16 alkyl group.

The polyester polyols represented by the above-described formula (XIX) are obtained through reaction of polyhydric alcohols represented by formula (XX):

$$R^{57}\,(OH)_f \qquad \text{(XX)}$$

wherein $R^{57}$ and f represent as described above, and carboxylic acids represented by formula (XXI);

$$R^{58}\,COOH \qquad \text{(XXI)}$$

wherein $R^{58}$ is the same as described above, or their reactive derivatives such as esters and acid halides.

Examples of the polyhydric alcohols represented by the above-described formula (XX) include ethylene glycol, diethylene glycol, propylene glycol, dipropylene glycol, butylene glycol, neopentylene glycol, trimethylolethane,. trimethylolpropane, glycerol, erythritol, pentaerythritol, dipentaerythritol, arabitol, sorbitol, and mannitol. Carboxylic acids represented by formula (XXI) may be linear or branched and may be saturated or unsaturated fatty acids. Examples of the carboxylic acids include acetic acid, propionic acid, butanoic acid, isobutanoic acid, pentanoic acid, isopentanoic acid, heptanoic acid, isoheptanoic pivalic acid, caproic acid, hexanoic acid, isohexanoic acid, heptanoic acid, isoheptanoic acid, octanoic acid, isooctanoic acid, 2-ethylhexanoic acid, nonanoic acid, 3,5,5-trimethylhexanoic acid, decanoic acid, undecanoic acid, 3-methylhexanoic acid, 2-ethylhexylic acid, caprylic acid, decanoic caid, lauric acid, myristic acid, palmitic acid, palmitoleic acid, stearic acid, isostearic acid, oleic acid, linoleic acid, and linolenic acid. Moreover, polybasic acids such as succinic acid, adipic acid, glutaric acid, sebacic acid, and maleic acid as well as monovalent fatty acids may be used in order to regulate the viscosity. The above-described polyhydric alcohol esters may be suitably selected in accordance with the kinematic viscosity of interest. In typical cases, they are selected so that the kinematic viscosity falls within the range of 2–500 $mm^2/s$ at 40° C.

The carbonate derivatives (d) may be those represented by formula (XXII):

$$R^{59}\underset{\underset{O}{\|}}{O}CO[(R^{60}O)_g\underset{\underset{O}{\|}}{C}O]_hR^{61} \qquad \text{(XXII)}$$

wherein each of $R^{59}$ and $R^{61}$, which may be identical to or different from each other, represents a hydrocarbon group having 30 or less carbon atoms or a C2–C30 hydrocarbon group having an ether linkage; $R^{60}$ represents a C2–C24 alkylene; g is an integer between 1 and 100 inclusive; and h is an integer between 1–10 inclusive.

In the above-described formula (XXII), each of $R^{59}$ and $R^{61}$ represents a hydrocarbon group having 30 or less carbon atoms or a C2–C30 hydrocarbon group having an ether linkage.

Examples of the hydrocarbon groups having 30 or less carbon atoms include aliphatic hydrocarbon groups such as a methyl group, an ethyl group, an n-propyl group, an isopropyl group, butyl groups, pentyl groups, hexyl groups, heptyl groups, octyl groups, nonyl groups, decyl groups, undecyl groups, dodecyl groups, tridecyl groups, tetradecyl groups, pentadecyl groups, hexadecyl groups, heptadecyl groups, octadecyl groups, nonadecyl groups, and eicosyl groups; alicyclic hydrocarbon groups such as a cyclohexyl group, an 1-cyclohexenyl group, a methylcyclohexyl group, a dimethylcyclohexyl group, a decahydronaphthyl group, and a tricyclodecanyl group; aromatic hydrocarbon groups such as a phenyl group, tolyl groups, xylyl groups, a mesityl group, and naphthyl groups; and aromatic-aliphatic hydrocarbon groups such as a benzyl group, a methylbenzyl group, a phenylethyl group, an 1-methyl-1-phenylethyl group, a styryl group, and a cinnamyl group.

Also, examples of the C2–C30 hydrocarbon groups having an ether linkage a glycol ether group may be represented by formula (XXIII):

$$-(R^{62}-O)_t-R^{63} \qquad \text{(XXIII)}$$

wherein $R^{62}$ represents an alkylene group having two or three carbon atoms (an ethylene group, a propylene group, a trimethylene group); $R^{63}$ represents an aliphatic, alicyclic, or aromatic hydrocarbon group having 28 or less carbon atoms (identical to groups described for $R^{59}$ and $R^{61}$); and i is an integer between 1 and 20 inclusive. Examples of the glycol ether groups include an ethylene glycol monomethyl ether group, an ethylene glycol monobutyl ether group, a diethylene glycol mono-n-butyl ether group, a triethylene glycol monoethyl ether group, a propylene glycol monoethyl ether group, a propylene glycol monobutyl ether group, a dipropylene glycol monoethyl ether group, and a tripropylene glycol mono-n-butyl ether group. Of these, preferable examples of $R^{62}$ and $R^{63}$ include alkyl groups such as an n-butyl group, an isobutyl group, an isoamyl group, a cyclohexyl group, an isoheptyl group, a 3-methylhexyl group, an 1,3-dimethylbutyl group, a hexyl group, an octyl group, and a 2-ethylhexyl group; and alkylene glycol monoalkyl ether groups such as an ethylene glycol monoethyl ether group, an ethylene glycol monobutyl ether group, a diethylene glycol monomethyl ether group, a triethylene glycol monomethyl ether group, a propylene glycol monomethyl ether group, a propylene glycol monobutyl ether group, a dipropylene glycol monoethyl ether group, and a tripropylene glycol mono-n-butyl ether group.

In the above-described formula (XXII), $R^{60}$ represents a C2–C24 alkylene group. Examples thereof include an ethylene group, a propylene group, a butylene group, an amylene group, a methylamylene group, an ethylamylene group, a hexylene group, a methylhexylene group, an ethylhexylene group, an octamethylene group, a nonamethylene group, a decamethylene group, a dodecamethylene group, and a tetradecamethylene group. When there are a plurality of $R^{60}O$ groups, they may be identical to or different from one another.

The polycarbonates represented by the formula (XXII) have a molecular weight (weight average molecular weight) of 300–3,000, preferably 400–1,500. When the molecular weight is less than 300, the kinematic viscosity is extremely low and the polycarbonates are not suitable for a lube oil, whereas when it is in excess of 3,000, the polycarbonates become wax-like and disadvantageous for use as lube oils.

These polycarbonates are manufactured by use of a variety of methods, typically from a carbonate ester-formable derivative such as a carbonate diester or phosgene and an aliphatic divalent alcohol.

In order to prepare the polycarbonates from these starting materials, there may be used conventional manufacturing methods such as the ester exchanging method or the phosgene method.

Any one of the polycarbonates described in detail in Japanese Patent Application Laid-Open (kokai) No. 3-217495 may be used as the above-described polycarbonates.

Moreover, there may be used as the carbonate derivative (d) glycol ether carbonates represented by formula (XXIV):

$$R^{64}—O—(R^{66}O)_j—CO—(OR^{67})_k—O—R^{65} \quad \text{(XXIV)}$$

wherein each of $R^{64}$ and $R^{65}$, which may be identical to or different from each other, represents a C1–C20 aliphatic, alicyclic, aromatic, or aromatic-aliphatic hydrocarbon group; each of $R^{66}$ and $R^{67}$, which may be identical to or different from each other, represents an ethylene group or an isopropylene group; and each of j and k is a number between 1 and 100 inclusive.

Examples of the aliphatic hydrocarbon groups for $R^{64}$ and $R^{65}$ in the above-described formula (XXIV) include a methyl group, an ethyl group, an n-propyl group, an isopropyl group, butyl groups, pentyl groups, hexyl groups, heptyl groups, octyl groups, nonyl groups, decyl groups, undecyl groups, dodecyl groups, tridecyl groups, tetradecyl groups, pentadecyl groups, hexadecyl groups, heptadecyl groups, octadecyl groups, nonadecyl groups, and eicosyl groups. Examples of the alicyclic hydrocarbon groups include a cyclohexyl group, an 1-cyclohexenyl group, a methylcyclohexyl group, a dimethylcyclohexyl group, a decahydronaphthyl group, and a tricyclodecanyl group. Examples of the aromatic hydrocarbon groups include a phenyl group, tolyl groups, xylyl groups, a mesityl group, and naphthyl groups. Examples of the aromatic-aliphatic hydrocarbon groups include a benzyl group, a methylbenzyl group, a phenylethyl group, a styryl group, and a cinnamyl group.

The glycol ether carbonate represented by the above-described formula (XXIV) may be manufactured through ester-exchange of a polyalkylene glycol monoalkyl ether in the presence of an excessive amount of an alcohol carbonate ester having a relatively low boiling point.

Any one of the glycol ether carbonates described in detail in Japanese Patent Application Laid-Open (kokai) No. 3-149259 may be used as the above-described glycol ether carbonates.

Moreover, there may also be used carbonate esters represented by formula (XXV):

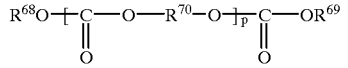

(XXV)

wherein each of $R^{68}$ and $R^{69}$, which may be identical to or different from each other, represents a C1–C15 alkyl group or a C2–C12 monohydric alcohol residue; $R^{70}$ represents a C2–C12 alkylene group; and p is an integer between 0 and 30 inclusive.

In the above formula (XXV), each of $R^{68}$ and $R^{69}$ represents a C1–C15, preferably C2–C9, alkyl group or a C2–C12, preferably C2–C9, monohydric alcohol residue; $R^{70}$ represents a C2–C12, preferably C2–C9, alkylene group; and p is preferably an integer between 1 and 30 inclusive. Use of carbonate esters which do not satisfy the above conditions is not preferred in order to avoid poor characteristics such as low compatibility with a coolant. Examples of the C1–C15 alkyl groups in $R^{68}$ and $R^{69}$ include a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, an n-dodecyl group, an n-tridecyl group, an n-tetradecyl group, an n-pentadecyl group, an isopropyl group, an isobutyl group, a tert-butyl group, an isopentyl group, an isohexyl group, an isoheptyl group, an isooctyl group, an isononyl group, an isodecyl group, an isoundecyl group, an isododecyl group, an isotridecyl group, an isotetradecyl group, and an isopentadecyl group.

Examples of the C2–C12 divalent alcohol residues include a residue of ethylene glycol, 1,3-propanediol, propylene glycol, 1,4-butanediol, 1,2-butanediol, 8-methyl-1,3-propanediol, 1,5-pentanediol, neopentylene glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol, and 1,12-dodecanediol.

Also, examples of the linear or branched C2–12 alkylene groups represented by $R^{70}$ include an ethylene group, a trimethylene group, a propylene group, a tetramethylene group, a butylene group, a 2-methyltrimethylene group, a pentamethylene group, a 2,2-dimethyltrimethylene group, a hexamethylene group, a 2-ethyl-2-methyltrimethylene group, a heptamethylene group, a 2-methyl-2-propyltrimethylene group, a 2,2-diethyltrimethylene group, an octamethylene group, a nonamethylene group, a decamethylene group, an undecamethylene group, and a dodecamethylene group.

No particular limitation is imposed on the molecular weight of the above-described carbonate esters. Preferably, esters having a number average molecular weight of 200–3,000, more preferably 300–2,000, may be used in consideration of their ability to increase sealing performance of the compressor.

Any one of the carbonate esters described in detail in Japanese Patent Application Laid-Open (kokai) No. 4-63893 may be used as the above-described carbonate esters.

Regarding polyether-ketones (e), there may be used compounds represented by formula (XXVI):

(XXVI)

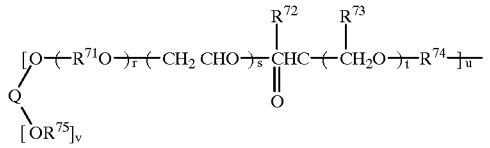

wherein Q represents an alcohol residue having 1–8 hydroxyl groups; $R^{71}$ represents a C2–C4 alkylene group; $R^{72}$ represents a methyl group or an ethyl group; each of $R^{73}$ and $R^{15}$, which may be identical to or different from each other, represents a hydrogen atom, an aliphatic, aromatic, or aromatic-aliphatic hydrocarbon group having 20 or less carbon atoms;

$R^{74}$ represents an aliphatic, aromatic, or aromatic-aliphatic hydrocarbon group having 20 or less carbon atoms; r and s are numbers between 0 and 30 inclusive; u is a number between 1 and 8 inclusive, v is a number between 0 and 7 inclusive, provided that u+v is a value between 1 and 8 inclusive; and t is 0 or 1.

In the above-described formula (XXVI), Q represents an alcohol residue having 1–8 hydroxyl groups. Examples of the monohydric aliphatic alcohols having Q as a residue include aliphatic alcohols such as methyl alcohol, ethyl alcohol, linear or branched propyl alcohol, butyl alcohol, pentyl alcohol, hexyl alcohol, heptyl alcohol, octyl alcohol, nonyl alcohol, decyl alcohol, undecyl alcohol, dodecyl alcohol, tridecyl alcohol, tetradecyl alcohol, pentadecyl alcohol, hexadecyl alcohol, heptadecyl alcohol, octadecyl alcohol, nonadecyl alcohol, and eicosyl alcohol; aromatic alcohols such as phenol, methylphenol, nonylphenol, octylphenol, and naphthol; aromatic-aliphatic alcohols such as benzyl alcohol and phenyl ethyl alcohol; and partially etherified compounds thereof. Examples of the dihydric alcohols include linear or branched aliphatic alcohols such as ethylene glycol, propylene glycol, butylene glycol, neopentylene glycol, and tetramethylene glycol; aromatic alcohols such as catechol, resorcinol, bisphenol A, and biphenyldiol; and partially etherified compounds thereof. Examples of the trihydric alcohols include linear or branched aliphatic alcohols such as glycerol, trimethylolpropane, trimethylolethane, trimethylolbutane, and 1,3,5-pentanetriol; aromatic alcohols such as pyrogallol, methylpyrogallol, and 5-sec-butylpyrogallol; and partially etherified compounds thereof. Examples of the alcohols having 4–8 hydroxyl groups include aliphatic alcohols such as pentaerythritol, diglycerol, sorbitan, triglycerol, sorbitol, dipentaerythritol, tetraglycerol, pentaglycerol, hexaglycerol, and tripentaerythritol and partially etherified compounds thereof.

In the above-described formula (XXVI), the C2–C4 alkylene group represented by $R^{71}$ may be linear or branched. Examples thereof include an ethylene group, a propylene group, an ethylethylene group, an 1,1-dimethylethylene group, and an 1,2-dimethylethylene group. Examples of the aliphatic, aromatic, or aromatic-aliphatic hydrocarbon groups having 20 or less carbon atoms represented by $R^{73}$ through $R^{75}$ include linear alkyl groups such as a methyl group, an ethyl group, a propyl group, a butyl group, a pentyl group, a heptyl group, an octyl group, a nonyl group, a decyl group, an undecyl group, a lauryl group, a myristyl group, a palmityl group, and a stearyl group; branched alkyl groups such as an isopropyl group, an isobutyl group, an isoamyl group, a 2-ethylhexyl group, an isostearyl group, and a 2-heptylundecyl group; aryl groups such as a phenyl group and a methylphenyl group; and aryl alkyl groups such as a benzyl group.

In formula (XXVI), r and s independently represent numbers between 0 and 30 inclusive. When r and s are in excess of 30, the etheric character becomes predominant in the polyether-ketone molecule to causes drawbacks such as poor compatibility with the coolant, degrated electric insulating property, and reduced moisture absorbability. As described above, u represents a number between 1 and 8 inclusive and v represents a number between 0 and 7 inclusive and the sum u+v falls within the range of 1–8 inclusive. These values represent average values and are not necessarily integers. t represents 0 or 1. $R^{71}$'s in the number of (r×u) or $R^{72}$'s in the number of (s×u) may be identical to or different from one another. When u is two or more, each of r, s, t, $R^{72}$, or $R^{74}$ in the number of u may be identical to or different from one another, whereas when v is two or more, $R^{75}$'s in the number of v may be identical to or different from one another.

The polyether-ketones represented by the above-described formula (XXVI) may be manufactured by a known method such as oxidation of a secondary alkyloxy alcohol with hypochlorite and acetic acid (Japanese Patent Application Laid-Open (kokai) No. 4-126716) or oxidation with zirconium hydroxide and a ketone (Japanese Patent Application Laid-Open (kokai) No. 3-167149).

Examples of the above-described (f) fluorinated oils include fluorinated silicone oil, perfluoropolyether, and a reaction product of an alkane and a perfluoro(alkyl vinyl) ether. Examples of the reaction products of alkane and perfluoro(alkyl vinyl) ether include those represented by formula (XXIX):

$$C_nH_{(2n+2-w)}(CF_2{=}CFHOC_mF_{2m+1})_w \quad \text{(XXIX)}$$

wherein w is an integer between 1 and 4 inclusive, n is an integer between 6 and 20 inclusive, and m is an integer between 1 and 4 inclusive, which are obtained by reacting an alkane represented by formula (XXVII):

$$C_nH_{2n+2} \quad \text{(XXVII)}$$

wherein n has the same meaning as described above, and a perfluoro(alkyl vinyl) ether represented by formula (XXVIII):

$$CF_2{=}CFOC_mF_{2m+1} \quad \text{(XXVIII)}$$

wherein m has the same meaning as described above.

The alkanes represented by the above-described formula (XXVII) may be linear, branched, or cyclic. Examples of alkanes include n-octane, n-decane, n-dodecane, cyclooctane, cyclododecane, and 2,2,4-trimethylpentane. Examples of perfluoro(alkyl vinyl) ethers represented by formula (XXVIII) include perfluoro(methyl vinyl ether), perfluoro(ethyl vinyl) ether, perfluoro(n-propyl vinyl) ether, and perfluoro(n-butyl vinyl) ether.

Examples of the above-described (g) polyalkylene glycols include compounds represented by the below-described formula (XXX):

$$R^{76}—[(OR^{77})_m—OR^{78}] \quad (XXX)$$

wherein $R^{76}$ represents a hydrogen atom, a C1–C10 alkyl group, a C2–C10 acyl group, or a C1–C10 aliphatic hydrocarbon group having 2–6 bonds connectable to the ether moiety; $R^{77}$ represents a C2–C4 alkylene group; $R^{78}$ represents a hydrogen atom, a C1–C10 alkyl group, or a C2–C10 acyl group; n is an integer between 1 and 6 inclusive; and m is a number which makes the average of m×n from 6 to 80.

The alkyl group included in $R^{76}$ and $R^{78}$ in the above-described formula (XXX) may be linear, branched, or cyclic. Examples of the alkyl groups include a methyl group, an ethyl group, an n-propyl group, an isopropyl group, butyl groups, pentyl groups, hexyl groups, heptyl groups, octyl groups, nonyl groups, decyl groups, a cyclopentyl group, and a cyclohexyl group. When the number of carbon atoms in the alkyl group is in excess of 10, compatibility with a coolant decreases and phase-separation may occur. Thus, the number of carbon atoms of the alkyl group is preferably from 2 to 6.

Also, an alkyl segment of the acyl group included in $R^{76}$ and $R^{78}$ may be linear, branched, or cyclic. Examples of the alkyl segment include the C1–C9 alkyl groups described in the above examples. When the number of carbon atoms in the acyl group is in excess of 10, compatibility with a coolant decreases to invite phase-separation. Thus, the number of carbon atoms of the acyl group is preferably from 2 to 6.

When both of $R^{76}$ and $R^{78}$ are alkyl groups or acyl groups, $R^{76}$ and $R^{78}$ may be identical to or different from each other.

When n is two or more, a plurality of $R^{78}$ in one molecule may be identical to or different from one another.

The C1–C10 aliphatic hydrocarbon groups having 2–6 connectable bonds included in $R^{76}$ may be linear or cyclic. Examples of the aliphatic hydrocarbon groups having two connectable bonds include an ethylene group, a propylene group, a butylene group, a pentylene group, a hexylene group, a heptylene group, an octylene group, a nonylene group, a decylene group, a cyclopentylene group, and a cyclohexylene group. Examples of the aliphatic hydrocarbon groups having 3–6 connectable bonds include hydroxyl-removed residues obtained from polyhydric alcohols such as trimethylolpropane, glycerol, pentaerythritol, sorbitol, 1,2,3-trihydroxycyclohexane, and 1,3,5-trihydroxycyclohexane.

When the number of carbon atoms in the aliphatic hydrocarbon group is in excess of 10, compatibility with a coolant decreases and phase-separation may occur. Thus, the number of carbon atoms is preferably 2 through 6.

$R^{77}$ in the above-described formula (XXX) is a C2–C4 alkylene group. Examples of the recurring unit containing $R^{77}$ include an oxyethylene group, an oxypropylene group, and an oxybutylene group. The oxyalkylene groups may consists of single species or two or more species. Of these, an oxypropylene unit is preferably incorporated in the molecule. Particularly, it may be incorporated in an amount of 50 mol % or more. When two or more oxyalkylene species are contained, the polymer may be a random or a block copolymer.

In the above-described formula (XXX), n is an integer between 1 and 6 inclusive and is determined in accordance with the number of the connectable bond in $R^{76}$. For example, when $R^{76}$ is an alkyl group or an acyl group, n is equal to 1, whereas when $R^{76}$ is an aliphatic hydrocarbon group having 2, 3, 4, 5, or 6 connectable bonds, n is equal to 2, 3, 4, 5, or 6, correspondingly. Also, m is a number making the average of m×n from 6 to 80. When the average of m×n does not fall within the above-described range, the effect of the invention may not fully be obtained.

The polyalkylene glycols represented by the above-described formula (XXX) may be terminated with a hydroxyl group. The polyalkylene glycols having a hydroxy-termination ratio of 50 mol % or less based on the total terminal groups may preferably be used. When the content of the hydroxyl group is in excess of 50 mol %, water absorbability may increase and viscosity index may decrease.

Examples of the polyalkylene glycols represented by the above-described formula (XXX) include polypropylene glycol dimethyl ether, polyethylene polypropylene glycol dimethyl ether, and polypropylene glycol monbutyl ether. Polypropylene glycol diacetate is preferred from the viewpoint of economy and effect.

Any one of the polyalkylene glycols described in detail in Japanese Patent Application Laid-Open (kokai) No. 2-305893 may be used as the polyalkylene glycols represented by the above-described formula (XXX).

Also, examples of the hydrocarbon-type synthetic oil include olefin polymers such as poly-α-olefin; alkylbenzene; and alkylnaphthalene.

In the refrigerating oil composition of the present invention, the above-described synthetic oils may be used singly or as a mixture so as to serve as the base oil.

Among the above-described synthetic oils, an oxygen-containing organic compound is preferred as the base oil in view of excellent compatibility with a coolant and lubrication properties. Polyvinyl ether and a polyhydric alcohol ester are particularly preferred.

Synthetic oils which may be used as the base oil of the present invention are not limited to the above-described examples. It should be noted that when a component (B); polyalkylene glycol derivative, is incorporated into the composition of the present invention, a compound that falls within the category of component (B) is not considered to be a base oil.

The base oil of the present invention may contain a mineral oil if needed, so long as the additive may not impair the effect of the present invention. Examples of mineral oils include paraffin-type mineral oils, naphthene-type mineral oils, and intermediate base crude mineral oils.

The refrigerating oil composition of the present invention may contain a variety of known additives as needed. Examples of additives include extreme pressure agents such as a phosphate ester or a phosphite ester; antioxidants such as a phenol compound or an amine compound; stabilizers of an epoxy compound type such as phenyl diglycidyl ether, cyclohexene oxide, or epoxidized soy bean oil; copper-inactivating agents such as benzotriazole or a derivative thereof; and defoaming agents such as silicone oil or fluorinated silicone oil.

Examples of coolants which may be used in refrigerators to which the refrigerating oil composition of the present invention is adapted include a hydrofluorocarbon-type, a fluorocarbon-type, a hydrocarbon-type, an ether-type, a carbon dioxide-type, and an ammonia-type coolant. Of these, a hydrofluorocarbon-type coolant is preferred. Examples of the preferable hydrofluorocarbon-type coolants include 1,1,1,2-tetrafluoroethane (R134a), difluoromethane (R32), pentafluoroethane (R125), and 1,1,1-trifluoroethane (R143a). These may be used singly or in combination of two or more species. These hydrofluorocarbons have no risk of destroying the ozone layer and thus are preferably used as coolants for a compression refrigerator. Also, examples of the coolant mixtures include a mixture of R32, R125, and R134a in proportions by weight of 23:25:52 (hereinafter referred to as R407C) and in proportions by weight of 25:15:60; a mixture of R32 and R125 in proportions by weight of 50:50 (hereinafter referred to as R410A); a mixture of R32 and R125 in proportions by weight of 45:55 (hereinafter referred to as R410B); a mixture of R125, R143a, and R134a in proportion by weight of 44:52:4 (hereinafter referred to as R404A); and a mixture of R125 and R143a in proportions by weight of 50:50 (hereinafter referred to as R507).

EXAMPLES

The present invention will next be described in detail by way of examples, which should not be construed as limiting the invention.

Examples 1 Through 10 and Referential Examples 1 and 2

The additives shown in Table 1 were added to the base oils shown in Table 1 in amounts based on the total weight of the composition shown in Table 1, to thereby prepare refrigerating oil compositions. Performance of these compositions was evaluated through a sealed tube test, a wear test, and a capillary-plugging test after use in an actual machine. The results are shown in Table 2.

(1) Sealed Tube Test

An Fe/Cu/Al catalyst and R410A/a sample oil/water (1 g/4 g/2,000 wt. ppm) were placed in a glass tube, which was then sealed. After the tube was allowed to stand at 175° C. for 10 days, appearance of the oil and the catalyst and sludge formation were observed, and increase in total acid value was determined.

(2) Wear Test

The wear test was conducted by use of a sealed block-on-ring test machine and A4032/SUJ2 as a block/ring material. The block/ring was set in the test machine, and a sample oil (100 g) and R410A (10 g) were placed therein. The test conditions were as follows: applied pressure 0.3 MPa, rotation 500 rpm, oil temperature 50° C., load 80 kg, and test time 60 minutes. Block wear widths of the samples were measured after the samples underwent the test.

(3) Test with a Real Machine

Refrigerating oil compositions containing a rust preventive oil (Oilcoat Z5; product of Idemitsu Petrochemical Co., Ltd.) in an mount of 1 wt. % were subject to a 6-month endurance test by use of an endurance tester for scroll compressors for package-type airconditioners. Pressure losses (%, relative to a new product) in capillary tubes were measured.

TABLE 1

| | OIL BASE | ADDITIVE (wt %) |
|---|---|---|
| Example 1 | 1 | A1 (5) |
| Example 2 | 1 | A2 (5) |
| Example 3 | 1 | A3 (5) |
| Example 4 | 1 | A4 (5) |
| Example 5 | 2 | A1 (5) |
| Example 6 | 2 | A2 (5) |
| Example 7 | 2 | A3 (5) |
| Example 8 | 3 | A4 (5) |
| Example 9 | 4 | A1 (25) |
| Example 10 | 5 | A2 (25) |
| Ref. Example 1 | 4 | |
| Ref. Example 2 | 5 | |

[NOTE]

Types of base oils:

1: Polyvinyl ethyl ether (A) · polyvinyl isobutyl ether (B) random copolymer; (A unit)/(B unit) (molar ratio) = 9/1.

Kinematic viscosity = 68 $mm^2/s$ (40° C.)

Number average molecular weight = 720

2: Polyvinyl ethyl ether (A) · polyvinyl isobutyl ether (B) random copolymer; (A unit)/(B unit) (molar ratia) = 7/3.

Kinematic viscosity = 68 $mm^2/s$ (40° C.)

Number average molecular weight = 710

3: Polyvinyl ethyl ether (A) · polyvinyl isobutyl ether (B) random copolymer; (A unit)/(B unit) (molar ratio) = 5/5.

Kinematic viscosity = 32 $mm^2/s$ (40° C.)

Number average molecular weight = 430

4: Ester of pentaerythritol and an acid mixture of 3,3,5-trimethylhexanoic acid and isooctanoic acid (molar ratio: 5/5).

Kinematic viscosity = 68 $mm^2/s$ (40° C.)

3,3,5-Trimethylhexanoic acid ester of trimethylolpropane

Kinematic viscosity = 56 $mm^2/s$ (40° C.)

Additives:

A1: Polypropylene glycol nonyl methyl ether

Kinematic viscosity = 20 $mm^2/s$ (40° C.)

Number average molecular weight = 400

A2: polypropylene glycol di-sec-butylphenyl methyl ether

Kinematic viscosity = 30 $mm^2/s$ (40° C.)

Number average molecular weight = 500

A3: polypropylene glycol nonylphenyl methyl ether

Kinematic viscosity = $mm^2/s$ (40° C.)

Number average molecular weight = 250

A4: polypropylene glycol polynonylene glycol dimethyl ether

Kinematic viscosity = 43 $mm^2/s$ (40° C.)

Number average molecular weight = 700

TABLE 2

| | REFREGIRATING OIL COMPOSITION | | | | | Capillary |
|---|---|---|---|---|---|---|
| | Sealed Tube Test | | | | Wear | pressure loss |
| | Oil appearance | Catalyst appearance | Total acid value*) | Sludge formation | width (mm) | in actual machine test (%) |
| Example 1 | Excellent | Excellent | 0.01 | None | 1.2 | 5 > |
| Example 2 | Excellent | Excellent | 0.01 | None | 1.1 | 5 > |

TABLE 2-continued

| | REFREGIRATING OIL COMPOSITION | | | | | Capillary |
|---|---|---|---|---|---|---|
| | Sealed Tube Test | | | | Wear | pressure loss |
| | Oil appearance | Catalyst appearance | Total acid value*) | Sludge formation | width (mm) | in actual machine test (%) |
| Example 3 | Excellent | Excellent | 0.01 | None | 1.2 | 5 > |
| Example 4 | Excellent | Excellent | 0.01 | None | 0.9 | 5 > |
| Example 5 | Excellent | Excellent | 0.01 | None | 1.1 | 5 > |
| Example 6 | Excellent | Excellent | 0.01 | None | 1.1 | 5 > |
| Example 7 | Excellent | Excellent | 0.01 | None | 1.2 | 5 > |
| Example 8 | Excellent | Excellent | 0.01 | None | 1.0 | 5 > |
| Example 9 | Yellow | Fe Blackish | 0.26 | None | 2.4 | 13 |
| Example 10 | Yellow | Fe Blackish | 0.28 | None | 2.3 | 14 |
| Ref. Example 1 | Brown | Fe Black | 0.38 | Formed | 3.3 | 38 |
| Ref. Example 2 | Brown | Fe Black | 0.46 | Formed | 3.1 | 53 |

[NOTE]: *) Increase in total acid value (mgKOH/g)

Examples 11 Through 30 and Referential Examples 3 and 4

The additives shown in Table 3 were added to the base oils shown in Table 3 in amounts based on the total weight of the compositions shown in Table 3, to thereby prepare refrigerating oil compositions. Performance of these compositions was evaluated through a sealed tube test, a wear test, and a capillary-plugging test after use in an actual machine. The results are shown in Table 4.

TABLE 3

| | BASE OIL | ADDITIVE (wt %) |
|---|---|---|
| Example 11 | 1 | A1 (5) |
| Example 12 | 1 | A1 (10) |
| Example 13 | 1 | A1 (20) |
| Example 14 | 1 | A2 (10) |
| Example 15 | 1 | A3 (10) |
| Example 16 | 1 | A4 (10) |
| Example 17 | 1 | A5 (10) |
| Example 18 | 1 | A6 (10) |
| Example 19 | 1 | A7 (10) |
| Example 20 | 1 | A8 (10) |
| Example 21 | 2 | A1 (10) |
| Example 22 | 2 | A2 (10) |
| Example 23 | 2 | A6 (10) |
| Example 24 | 2 | A7 (10) |
| Example 25 | 3 | A3 (10) |
| Example 26 | 3 | A4 (10) |
| Example 27 | 4 | A5 (10) |
| Example 28 | 4 | A8 (10) |
| Example 29 | 5 | A1 (30) |
| Example 30 | 6 | A2 (30) |
| Ref. Ex. 3 | 5 | — |
| Ref. Ex. 4 | 6 | — |

[NOTE]

Types of base oils:

Polyvinyl ethyl ether (A) · polyvlnyl isobutyl ether (B) random copolymer; (A unit)/(B unit) (molar ratio) = 9/1.

Kinematic viscosity = 68 $mm^2/s$ (40° C.)

Number average molecular weight = 720

TABLE 3-continued

| BASE OIL | ADDITIVE (wt %) |
|---|---|

2: Polyvinyl ethyl ether (A) · polyvinyl isobutyl ether (B) random copolymer; (A unit)/(B unit) (molar ratio) = 5/5.

Kinematic viscosity = 32 $mm^2/s$ (40° C.)

Number average molecular weight = 430

3: Polyoxypropylene glycol dimethyl ether

Kinematic viscosity = 41 $mm^2/s$ (40° C.)

Number average molecular weight = 1050

4: Polyoxypropylene (A) · polyoxyethylene (B) glycol monobutyl ether random copolymer; (A unit)/(B unit) (molar ratio) = 9/1.

Kinematic viscosity = 56 $mm^2/s$ (40° C.)

Number average molecular weight = 1000

5: 3,5,5-Trimethylhexanoic acid triester of trimethylolpropane

Kinematic viscosity = 56 $mm^2/s$ (40° C.)

Number average molecular weight = 542

6: Complex ester of trimethylolpropane and adipic acid

Kinematic viscosity = 68 $mm^2/s$ (40° C.)

Number average molecular weight = 820

Additives:

A1: Hexa n-propyl ether of sorbitol

Kinematic viscosity = 32 $mm^2/s$ (40° C.)

A2: Tetra n-hexyl ether of pentaerythritol

Kinematic viscosity = 38 $mm^2/s$ (40° C.)

A3: Diphenyl octyl triether of glycerol

Kinematic viscosity = 25 $mm^2/s$ (40° C.)

A4: Di(methyloxyisopropylene)dodecyl triether of trimethylolpropane

Kinematic viscosity = 33 $mm^2/s$ (40° C.)

A5: Dimethyl dioctyl tetraether of diglycerol

Kinematic viscosity = 30 $mm^2/s$ (40° C.)

A6: Tetra(methyloxyisopropylene)decyl pentaether of triglycerol

Kinematic viscosity = 60 $mm^2/s$ (40° C.)

A7: Hexapropyl ether of dipentaerythritol

Kinematic viscosity = 43 $mm^2/s$ (40° C.)

A8: pentamethyl octyl hexaether of tripentaerythritol

Kinematic viscosity = 56 $mm^2/s$ (40° C.)

TABLE 4-1

| | REFREGIRATING OIL COMPOSITION | | | | | Capillary |
|---|---|---|---|---|---|---|
| | Sealed Tube Test | | | | Wear | pressure loss in |
| | Oil appearance | Catalyst appearance | Total acid value*) | Sludge formation | width (mm) | actual machine test (%) |
| Example 11 | Excellent | Excellent | 0.03 > | None | 1.6 | 9 |
| Example 12 | Excellent | Excellent | 0.03 > | None | 1.5 | 7 |
| Example 13 | Excellent | Excellent | 0.03 > | None | 1.2 | 5 |
| Example 14 | Excellent | Excellent | 0.03 > | None | 1.5 | 8 |
| Example 15 | Excellent | Excellent | 0.03 > | None | 1.0 | 6 |
| Example 16 | Excellent | Excellent | 0.03 > | None | 1.0 | 6 |
| Example 17 | Excellent | Excellent | 0.03 > | None | 0.9 | 7 |
| Example 18 | Excellent | Excellent | 0.03 > | None | 1.1 | 8 |
| Example 19 | Excellent | Excellent | 0.03 > | None | 1.4 | 9 |
| Example 20 | Excellent | Excellent | 0.03 > | None | 1.2 | 8 |
| Example 21 | Excellent | Excellent | 0.03 > | None | 1.5 | 8 |

TABLE 4-2

| | REFREGIRATING OIL COMPOSITION | | | | | Capillary |
|---|---|---|---|---|---|---|
| | Sealed Tube Test | | | | Wear | pressure loss in |
| | Oil appearance | Catalyst appearance | Total acid value*) | Sludge formation | width (mm) | actual machine test (%) |
| Example 22 | Excellent | Excellent | 0.03 > | None | 1.5 | 9 |
| Example 23 | Excellent | Excellent | 0.03 > | None | 1.1 | 8 |
| Example 24 | Excellent | Excellent | 0.03 > | None | 1.3 | 9 |
| Example 25 | Excellent | Excellent | 0.03 > | None | 0.9 | 8 |
| Example 26 | Excellent | Excellent | 0.03 > | None | 0.9 | 9 |
| Example 27 | Excellent | Excellent | 0.03 > | None | 1.1 | 8 |
| Example 28 | Excellent | Excellent | 0.03 > | None | 1.3 | 9 |
| Example 29 | Yellow | Fe Blackish | 0.35 | None | 2.5 | 17 |
| Example 30 | Yellow | Fe Blackish | 0.58 | None | 2.8 | 24 |
| Ref. Example 3 | Brown | Fe Black | 1.5 | Formed | 3.9 | 100% clogged |
| Ref. Example 4 | Brown | Fe Black | 1.5 | Formed | 4.2 | 100% clogged |

The refrigerating oil compositions of the present invention exhibit excellent lubrication performance, and in particular, exhibit improved lubrication between aluminum material and steel material, to thereby suppress wear of the materials. They are advantageously used for refrigerators in which coolants which do not cause environmental pollution are employed.

Accordingly, excellent effects of the refrigerating oil compositions of the present invention are appreciable particularly when they are used for air conditioners for automobiles, household air conditioners, and electric refrigerators, and thus, their industrial value are quite high.

What is claimed is:

1. A refrigerating oil composition obtained by incorporating, into (A) a base oil containing a synthetic oil, (C) at least one ethterified compound having a kinematic viscosity of 5–200 $mm^2/s$ at 40° C. and selected from the group consisting of (c-1) etherified compounds of aliphatic polyhydric alcohols having functionality of 3 through 6 and (c-2) etherified compounds of dimeric or trimeric condensates of aliphatic polyhydric alcohols having functionality of 3 through 6.

2. A refrigerating oil composition according to claim 1, wherein the amount of the etherified compound is 0.1–30 wt. %.

3. A refrigerating oil composition which comprises a synthetic oil containing the etherified compound as described in claim 1 in an amount of 0.1–30 wt. %.

4. A refrigerating oil composition which comprises the etherified compound as described in claim 1 and a synthetic oil other than the etherified compound.

5. A refrigerating oil composition according to claim 1, wherein the amount of the etherified compound is 0.1–30 wt. %, and that of the synthetic oil other than the etherified compound is 70–99.9 wt. %.

6. A refrigerating oil composition according to claim 1, wherein the etherified compounds are (c-1) etherified compounds of aliphatic polyhydric alcohols having functionality of 3 through 6.

7. A refrigerating oil composition according to claim 6, wherein the polyhydric alcohols of the group (c-1) are glycerol, trimethylolpropane, erythritol, pentaerythritol, arabitol, sorbitol, and mannitol.

8. A refrigerating oil composition according to claim 1, wherein the dimeric or trimeric condensates of the polyhydric alcohols are diglycerol or dipentaerythritol, or triglycerol or tripentaerythritol.

9. A refrigerating oil composition according to claim 1, wherein the etherified compounds are etherified products of dimeric condensates of aliphatic polyhydric alcohols having functionality of 3 through 6.

10. A refrigerating oil composition according to claim 9, wherein the dimeric condensates of the polyhydric alcohols are diglycerol and dipentaerythritol.

11. A refrigerating oil composition according to claim 1, wherein the etherified compounds are etherified products of trimeric condensates of aliphatic polyhydric alcohols having functionality of 3 through 6.

12. A refrigerating oil composition according to claim 11, wherein the trimeric condensates of the polyhydric alcohols are triglycerol and tripentaerythritol.

* * * * *